US006809282B2

(12) United States Patent
Fasano

(10) Patent No.: US 6,809,282 B2
(45) Date of Patent: Oct. 26, 2004

(54) D.C. CIRCUIT BREAKER WITH MAGNETS FOR REDUCING CONTACT ARCING

(75) Inventor: Michael A. Fasano, Waterbury, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 10/243,450

(22) Filed: Sep. 12, 2002

(65) Prior Publication Data

US 2004/0051605 A1 Mar. 18, 2004

(51) Int. Cl.[7] ..... H01H 9/44
(52) U.S. Cl. ..... 218/40; 218/15; 218/148
(58) Field of Search ..... 218/15, 22, 29, 218/34–40, 148, 149, 151, 156, 157; 335/59–64, 177–179, 6, 14, 20, 16, 147

(56) References Cited

U.S. PATENT DOCUMENTS 5,053,736 A * 10/1991 Fasano ..... 335/62
5,744,772 A * 4/1998 Fasano ..... 218/40
5,818,003 A * 10/1998 Moldovan et al. ..... 218/26

* cited by examiner

*Primary Examiner*—Lincoln Donovan
*Assistant Examiner*—M. Fishman
(74) *Attorney, Agent, or Firm*—McCormick, Paulding & Huber LLP

(57) ABSTRACT

An electromagnetic circuit breaker is provided with a pair of magnets on opposing sides of the contacts in the open position. A magnetic field generated by the magnets combines with the magnetic field generated by the electrical arc created upon opening of the contacts during an overcurrent condition sensed by the breaker. The combined magnetic fields deflect the arc current, shifting the arc current away from the contact points and lengthening the path of the arc, thereby increasing the voltage rating of the breaker, by decreasing the intensity of an associated arc current.

6 Claims, 3 Drawing Sheets

D.C. CIRCUIT BREAKER WITH MAGNETS FOR REDUCING CONTACT ARCING

BACKGROUND OF THE INVENTION

This invention relates generally to electromagnetic circuit breakers of the type having a housing made in two half sections, each of which sections is molded from a plastic dielectric material. The half sections are held together by fasteners so as to support a circuit breaker mechanism and terminal components between these half sections.

Such circuit breakers are designed to provide load current and voltage through an electromagnetic coil that surrounds a delay tube in which a plunger or core is adapted to be drawn magnetically toward a pole piece at the end of the delay tube by the flux created in a frame and an armature. The frame is mounted between the circuit breaker half sections to support for both the coil, generally on a bobbin or the like, and also to support the circuit breaker mechanism that is adapted to be tripped by the movable armature.

The armature engages a sear to open the electrical contacts provided in an arc chamber that is also defined in the housing. The arc chamber may be vented to release gases generated when the contacts open. This avoids the build up of excessive heat and pressure within the circuit breaker housing.

prior art circuit breakers of this type often include angled slots which are generally molded into the half sections of the circuit breaker housing to receive U-shaped arc splitter plates that are arranged in spaced relationship along the path of movement for the movable contact as it travels from a closed position, in engagement with the fixed contact provided on one of the terminal studs in the circuit breaker housing, to an open position where it is spaced from the fixed contact. The movable contact is generally provided on the underside of the movable contact arm for this purpose. The contact arm provides for the electrical path through the movable contact to the fixed contact in the contacts closed condition of the circuit breaker.

SUMMARY OF THE INVENTION

The present invention relates to improving the arc suppressant capabilities of a circuit breaker. The improved circuit breaker of the present invention does not utilize arc splitter plates such as those used with prior art circuit breakers described above. In accordance with the present invention, a pair of magnets is provided supported by the housing on opposing sides of the path taken by the arc current. The arc current is generated between the movable and fixed contacts when the movable contact arm moves away from the fixed contact as the contacts open in response to an overcurrent.

The movable contact arm can be activated and moved away from the fixed contact generating an arc current, either by the circuit breaker mechanism in response to an overcurrent situation, or manually via a switch coupled to the circuit breaker mechanism. The arc current generates a magnetic field oriented concentrically of the axis or path of the arc current. The direction of the magnetic field is clockwise when viewed in the direction of the arc current, as can be determined by using the "Right Hand Rule" with respect to the direction of the arc current. This magnetic field generated by the arc current is referred to herein as a first magnetic field.

In accordance with the present invention, a second magnetic field is generated by a pair of magnets disposed on opposing sides of the arc current path. The magnets are arranged to generate the second magnetic field transverse to the first magnetic field. The first and second magnetic fields combine to deflect the arc current. The deflection of the arc current lengthens the path of the arc, which increases the voltage for the arc, thereby decreasing the current and providing less extreme conditions of heat and pressure inside the breaker housing as well as providing conditions for reliable arc extinction. The elongation of the arc increases the arc resistance and thereby increases the arc voltage. On direct current (D.C.) devices when the arc voltage is increased above the supply voltage the arc is extinguished rapidly. This is necessary on breakers where there is insufficient distance (gap) between the movable and stationary contacts.

The circuit breaker housing has a conventional vent opening near the deflected arc current so that heat and gas pressure generated by the arc current can escape, further reducing the heat and pressure interior the housing.

In further accordance with the present invention, the pair of magnets are preferably permanent magnets of the type containing neodymium. Alternatively, other types of magnets could be used without departing from the scope of the present invention.

BRIEF DESCRIPTION OF THE DRAWINGS

FIG. 1 shows the movable contacts of the breaker in a closed position.

FIG. 2 shows the contacts in the open position.

FIG. 3 shows the arc current directed away from the viewer.

DETAILED DESCRIPTION OF THE PREFERRED EMBODIMENT

Figure 1:
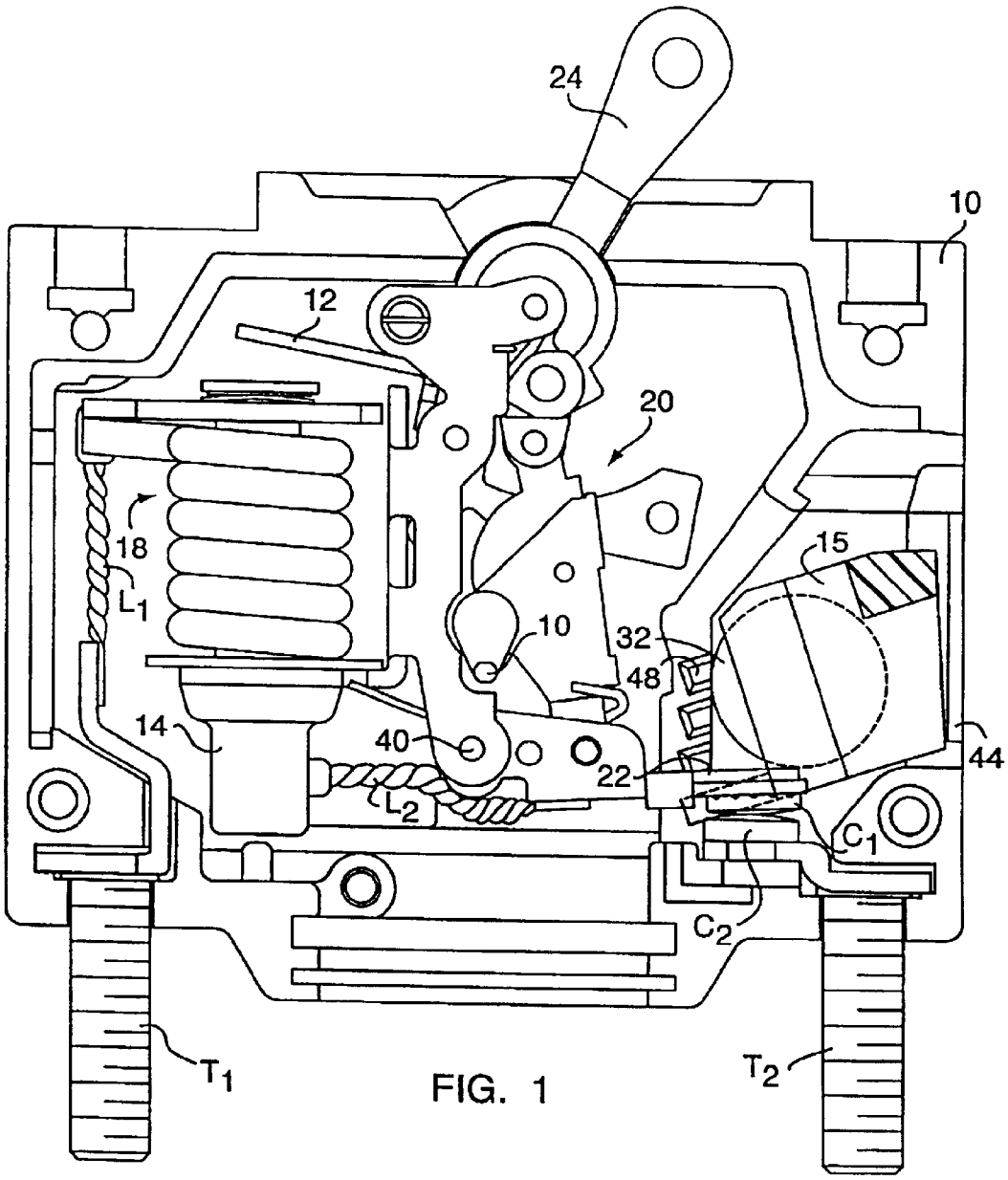
FIG. 1 is an elevational view of one embodiment of the present invention illustrating one half section of a molded case circuit breaker housing showing the various components of a circuit breaker mechanism including one of the pair of magnets shown proximate the movable contact arm.

Turning now to the drawings in greater detail, FIG. 1 shows a magnetic circuit breaker having a conventional circuit breaker mechanism such as that disclosed in U.S. Pat. No. 4,347,488 entitled "MULTI-POLE CIRCUIT BREAKER" issued Aug. 31, 1982 and assigned to the assignee herein. Such a circuit breaker mechanism includes a collapsible link 20 that is provided between a movable contact arm 22 and a pivotably mounted toggle actuator 24. The collapsible link is adapted to be operated without collapsing by the actuator 24 so as to achieve direct opening and closing movement of the movable contact arm 22 between the positions illustrated in FIG. 1 and FIG. 2 herein. Such a circuit breaker is connected in a circuit to be protected through terminals $T_1$ and $T_2$. Terminal $T_1$ is connected by a lead $L_1$ to an internal electromagnetic coil 18, and from the coil to the movable contact arm by a lead $L_2$. When the movable contact arm 22 is in the position shown for it in FIG. 1, a movable contact $C_1$ provided on the movable contact arm 22 engages a fixed contact $C_2$ mounted on the fixed post or terminal $T_2$. Thus, electrical current can flow through the coil 18 and, unless that current flow is manually interrupted by movement of the toggle actuator 24, the current in a circuit in which the circuit breaker is provided will continue to flow until the current in that circuit and hence in the coil 18 exceeds a predetermined level for the magnetic circuit breaker for which the magnetic circuit breaker is designed. At this point, such over current condition in the coil 18 will alter the magnetic circuit of the breaker mechanism pulling a core (not shown) inside the coil and inside the element 14 upwardly, thereby drawing the armature 12 downwardly. The armature 12 includes a depending leg (not shown) that will cause the pin means 10 to rotate in a counterclockwise direction collapsing the link 20 so that the spring biased movable contact arm 22 moves from its closed position of FIG. 1 to the open position illustrated in FIG. 2.

The opening movement of the contacts as described in the preceding paragraph can be accompanied by the formation of a visible arc current between the movable contacts. Such an arc current is indicated generally by the Line A in FIGS. 2 and 6. Referring now to FIG. 3, the arc current A generates a magnetic field 36 oriented concentrically the axis of the arc current A. This magnetic field 36 generated by the arc current A is referred to herein as the first magnetic field. The first magnetic field 36 is directed clockwise when viewed in the direction of the arc current A established using the "Right Hand Rule" with respect to the direction of the arc current A.

Figure 3:
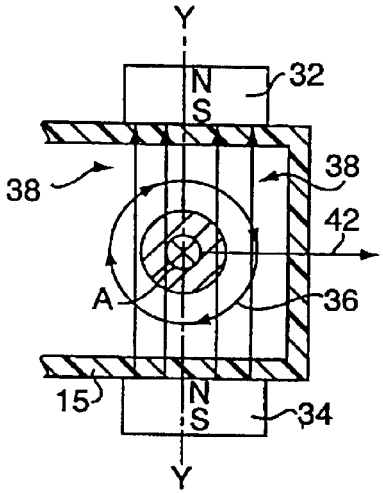
FIG. 3 is a schematic top view of the breaker contacts of the present invention illustrating the first and second magnetic fields with respect to the arc current.
Figure 4:
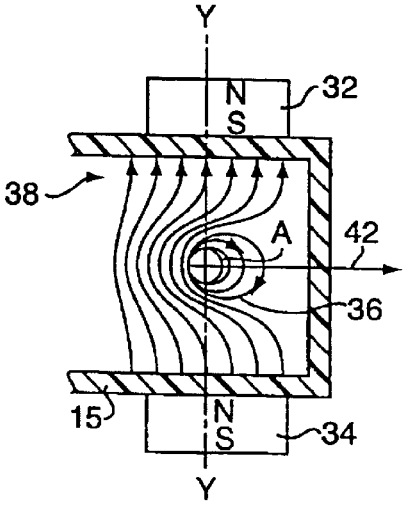
FIG. 4 is a schematic top view of the breaker contacts illustrating the force generated by the combined first and second magnetic fields.
Figure 5:
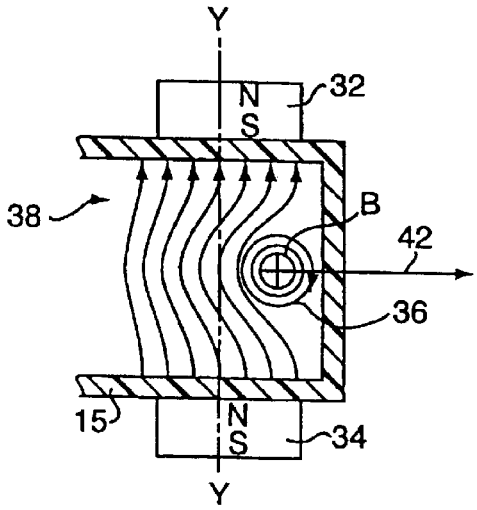
FIG. 5 is a schematic top view of the breaker contacts illustrating the result of the force depicted in FIG. 4 and showing the arc displaced.

Referring again to FIG. 3, the present invention provides a pair of magnets 32 and 34 supported by a cradle 15. The magnets 32 and 34 are arranged with opposite poles facing one another such that a second magnetic field 38 is generated between the magnets as shown by flux lines illustrated in FIG. 3. The cradle 15, of nylon or other non-magnetic material serves to maintain the magnets 32 and 34 in spaced relationship at opposing sides of the path of the arc current A. As shown in FIG. 3, the first magnetic field 36 is generally in the same direction as the second magnetic field 38 on the left or inner side of the datum Y-Y in this view. The outer side of datum Y-Y shows the first and second magnetic fields, 36 and 38 respectively, oriented in opposite directions. As a result, the first magnetic field 36 combines with the second magnetic field 38 to generate a force 42 acting on the arc current A in an outward direction generally perpendicular to the current direction as shown in FIG. 4. The resultant of the combined first and second magnetic fields is shown in FIG. 5 wherein the deflected arc current B is shifted away from the datum Y-Y.

Figure 6:
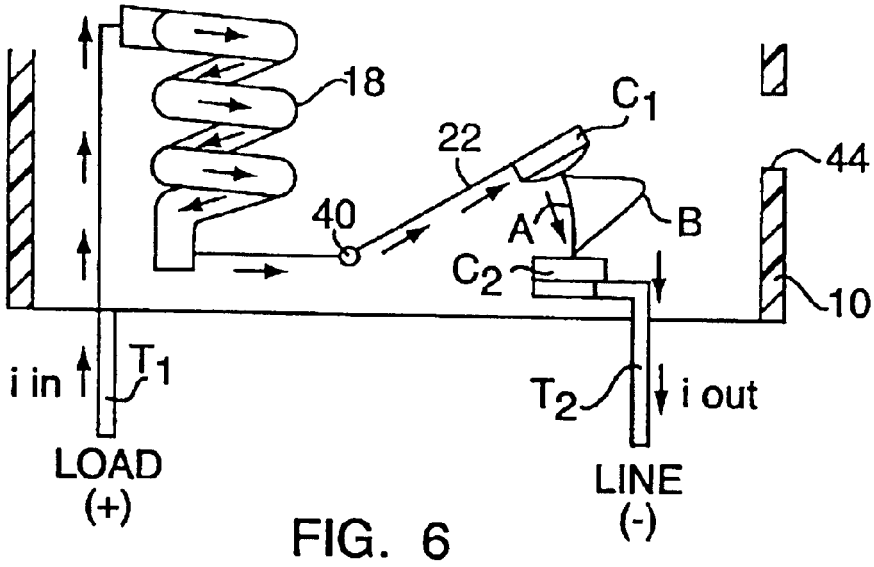
FIG. 6 is a schematic of the present invention breaker circuit showing the direction of the arc current as well as the relative positions of the initial arc current A and the deflected arc current B.

In the preferred embodiment, the deflected arc current B is directed outwardly away from the pivot point 40 of the movable contact arm 22 towards the housing vent opening 44. FIG. 6 shows the deflected arc current B directed towards vent 44 in the housing 10 such that heat and pressure generated by the deflected arc current B can escape the interior of the housing 10. The deflection in the arc current, lengthens the path of arc current, as illustrated by the deflected arc current B in FIG. 6, increasing the voltage of the arc, and decreases the arc current intensity. Thus, less wear on the contacts $C_1$ and $C_2$ prolongs the life of the breaker.

Figure 7:
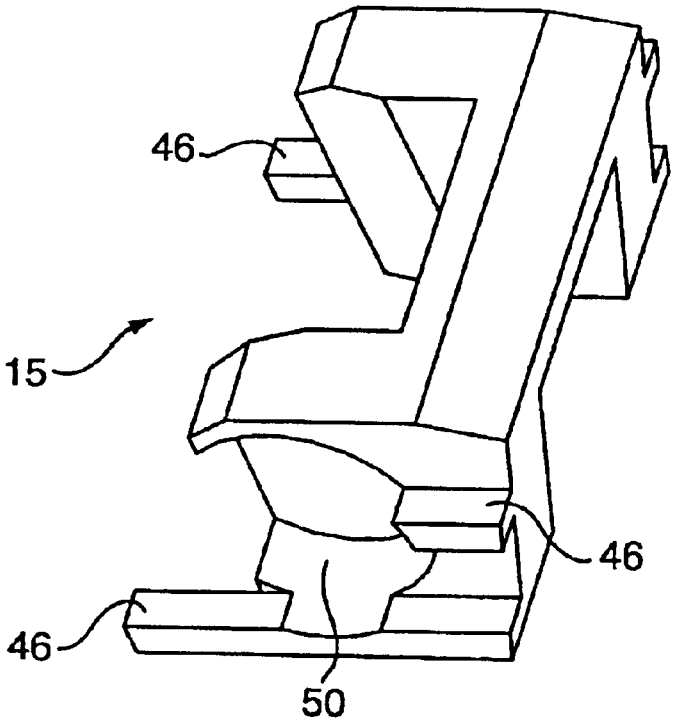
FIG. 7 is a perspective view of a magnet cradle for use with the FIG. 1 embodiment of the present invention.

In the FIG. 1 embodiment, the magnet cradle 15 is designed to mount in the typically angled slots of prior art circuit breaker housings designed to accommodate arc plates. The present invention circuit breaker does not require the arc plates of the prior art, however, the slots therefor can be utilized to support the magnet cradle 15 which, in turn, supports the magnets 32 and 34 on opposing sides of the arc current A. FIG. 7 shows the magnet cradle 15 adapted to mount in a circuit breaker housing 10 such as the FIG. 1 embodiment. The magnet cradle 15 has support members 46 which mount in the angled slots 48 in the breaker housing 10. The recessed area 50, shown only on one side of the magnet cradle 15 in FIG. 7, receives and retains one of the pair of magnets 32 and 34 as previously described. Alternatively, the magnets 32 and 34 can be supported directly by the housing 10 or in a cradle coupled in other ways to a housing 10 which does not have the angled arc plate slots.

Figure 2:
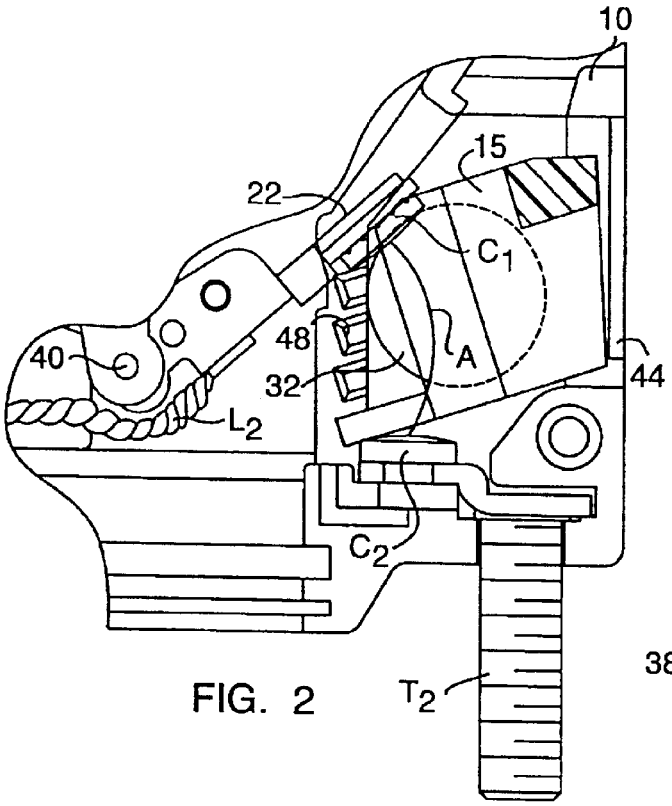
FIG. 2 is similar to FIG. 1, showing only that portion of the circuit breaker necessary to illustrate the operation of the movable contact arm.

It will be apparent that the electrical arc current A created upon an over current condition is at least initially oriented between the contacts $C_1$ and $C_2$ on the line A as shown in FIGS. 2 and 6. However, as a result of the combination of the first magnetic field 36 and the second magnetic field 38, described above, the arc current A is deflected outwardly away from the pivot point 40 of the movable contact arm 22 in the direction of the vector 42 shown in FIG. 3. The invention disclosed herein provides a convenient structure for causing the arc current A to migrate from the suggested position for the arc as depicted in FIGS. 2 and 6 to follow a longer curved path such as that illustrated by the arc current B in FIGS. 5 and 6 as a result of the magnetic flux pattern created by the pair of magnets 32 and 34.

It should be noted that the magnets can be provided in various positions and orientations relative to the direction and position of the arc current so long as they appropriately deflect the arc current as desired. Furthermore, additional magnets or pairs of magnets may be utilized to provide greater deflection in the arc current, or to further alter the path of the arc current, or for other purposes which will be apparent to one skilled in the art.

In conclusion, the present invention provides magnets disposed proximate the arc current in a circuit breaker providing an improved circuit breaker capable of accommodating overvoltage and/or overcurrents, and the associated arcing of the breaker contacts. Additionally, the present invention avoids the propensity for the arc to deteriorate the contacts as a result of remaining in the position illustrated at A in FIGS. 2 and 4 in the above-described embodiments. It also avoids regression of the arc rearwardly toward the pivoted end 40 of the movable contact arm 22. More specifically, this invention provides for deflection of the arc away from the movable and fixed contacts, to a location where the arc is stretched out generating a relatively higher arc voltage and lowering the arc current. As a result, the surrounding circuit breaker structure is not damaged by the arc to the extent that would occur absent these uniquely configured components.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A circuit breaker comprising:

a housing defining an internal chamber;

a circuit breaker mechanism provided in said chamber and including a movable contact arm pivotably mounted in said housing for movement from a closed to an open position in response to an overcurrent condition that is detected by said circuit breaker mechanism;

a movable contact provided on said movable contact arm, a fixed contact provided for engagement by said movable contact when said movable contact arm is in the closed position, said movable and fixed contacts generating an arc current upon opening of said movable contact arm, said arc current providing a first magnetic field set up by said arc current, said first magnetic field being circular about an axis generally oriented between said fixed and movable contacts, a non-magnetic cradle supported in slots provided in said housing, a pair of permanent magnets disposed in said non-magnetic cradle, the pair of permanent magnets supported on opposing sides of said arc current and said first magnetic field axis, said pair of permanent magnets generating a second magnetic field oriented transverse to said first magnetic field axis and being otherwise not coupled magnetically, said first and second magnetic fields combining to create a resultant magnetic field to deflect the arc current away from said movable contact arm and from said movable and fixed contacts for lengthening the path of said arc current; and whereby said arc current is extinguished without the need for splitter plates disposed in said housing.

2. The circuit breaker according to claim 1, wherein said permanent magnets comprise neodymium.

3. The circuit breaker according to claim 1 wherein said housing further comprises a vent positioned such that said resultant magnetic field deflects said arc current towards said vent for allowing heat created by said arc current to escape from said chamber therethrough.

4. The circuit breaker according to claim 1 wherein said pair of magnets comprises a plurality of magnets.

5. The circuit breaker according to claim 1 wherein said arc current is deflected away from said pivotal mount of said movable contact arm.

6. The circuit breaker according to claim 1 wherein said circuit breaker is rated for direct current (D.C.) circuits.

* * * * *